United States Patent [19]

Fork

[11] 4,225,286

[45] Sep. 30, 1980

[54] THRUST GENERATING DEVICE

[75] Inventor: Werner Fork, Heidenheim, Fed. Rep. of Germany

[73] Assignee: J. M. Voith GmbH, Heidenheim, Fed. Rep. of Germany

[21] Appl. No.: 869,895

[22] Filed: Jan. 16, 1978

[30] Foreign Application Priority Data

Jan. 19, 1977 [DE] Fed. Rep. of Germany ..... 2701914

[51] Int. Cl.[3] ..... F01D 1/36; F03B 5/00

[52] U.S. Cl. ..... 416/4; 416/108; 416/111

[58] Field of Search ..... 416/111 A, 108 A, 4; 115/52; 244/10, 21, 39

[56] References Cited

U.S. PATENT DOCUMENTS

| | | | |
|---|---|---|---|
| 1,744,924 | 1/1930 | Sargent | 416/4 |
| 1,923,971 | 8/1933 | Evans | 416/4 |
| 2,250,772 | 7/1941 | Mueller | 416/108 |
| 2,307,418 | 1/1943 | McDonald | 416/4 |
| 2,753,006 | 7/1956 | Franz | 416/108 A |
| 2,950,765 | 8/1960 | Magnuson | 416/108 A |
| 2,971,583 | 2/1961 | Hansen et al. | 416/111 |
| 3,241,618 | 3/1966 | Baer | 115/52 |
| 3,326,296 | 6/1967 | Hill et al. | 416/92 |
| 3,700,349 | 10/1972 | Fork | 416/111 |

FOREIGN PATENT DOCUMENTS

| | | | |
|---|---|---|---|
| 103660 | 7/1926 | Fed. Rep. of Germany | 416/4 |
| 2029995 | 2/1972 | Fed. Rep. of Germany | 416/108 A |
| 249730 | 4/1926 | United Kingdom | 416/4 |

*Primary Examiner*—Everette A. Powell, Jr.
*Assistant Examiner*—A. N. Trausch, III
*Attorney, Agent, or Firm*—Edwin E. Greigg

[57] ABSTRACT

A device for generating a thrust in a liquid utilizing rotating cylinders. The cylinders are mounted on a rotatable hub and rotate about their own axes relative to the hub. The relative rotation follows, preferably, a sinusoidal path for producing the thrust, and in particular, each cylinder undergoes a reversal in its direction of rotation after each half rotation of the hub. A common control bar is included which is connected to each cylinder and eccentrically with respect to the axis of rotation of the hub so that the points of reversal and the direction of thrust can be adjusted.

2 Claims, 11 Drawing Figures

Y
90°
P3
2
ω1
P2
P4
ω1 max
ω1
1
ωR
P1
0°
180°
ω=0
ω=0
X
3
P5
P8
ω2
ω2
P6
ω2 max
P7
270°

ω 1

0
180°
360°
ρ1,2
|ω1|=|ω2|
ω 2

Fig. 3
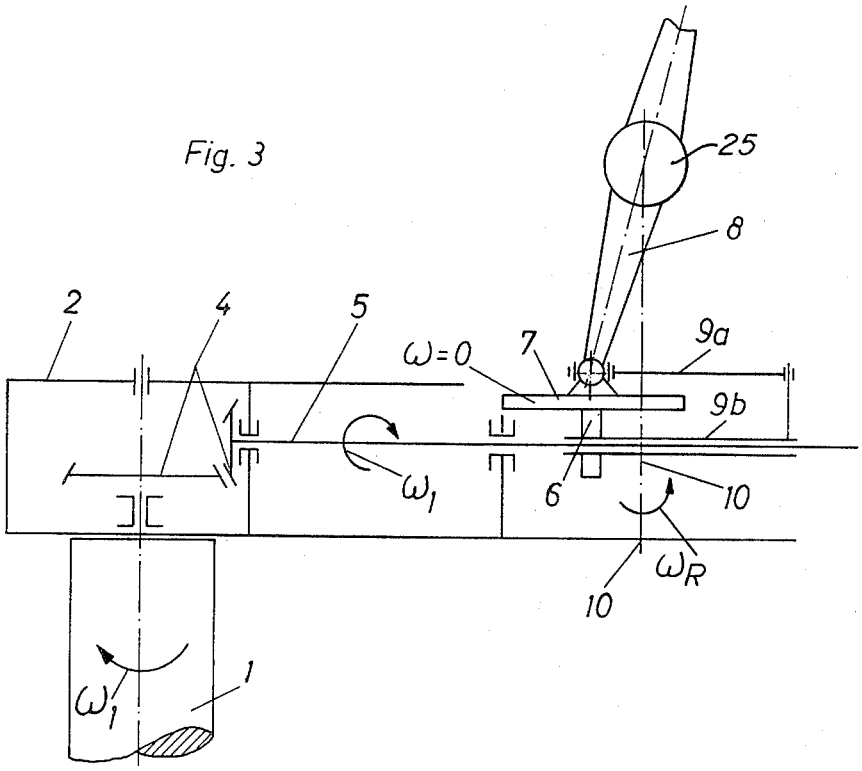
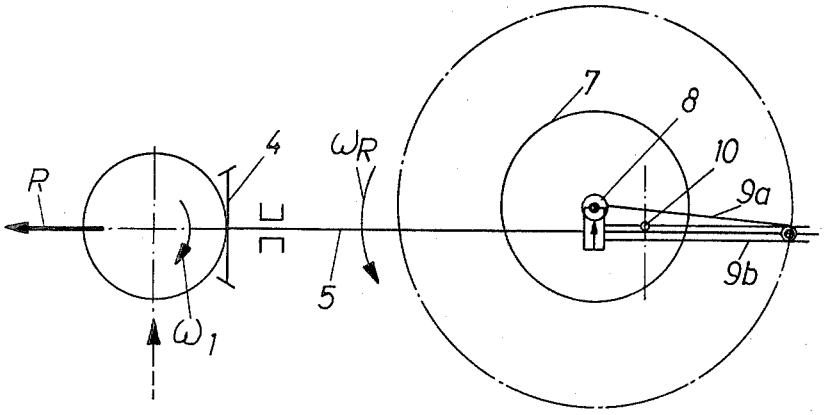
Fig. 4

THRUST GENERATING DEVICE

BACKGROUND OF THE INVENTION

The invention relates to a device for generating a thrust in a liquid with a rotary hub on which thrust-generating members with axes of rotation extending parallel with the axis of rotation of the hub are disposed. The members are connected by a linkage in each case to a common control bar.

Devices of this kind are used for driving ships, for example in the form of a cycloid propeller, such as for instance the Voith Schneider propeller. By means of these thrust members, the rotational axes of which are arranged at right angles to the surface of the water, the thrust forces can be adjusted in magnitude and direction as desired. Here the thrust members are in the form of vanes which swing to-and-fro about their vertical axis during one revolution of the hub.

In many cases there is a disadvantage here in that the thrust members are susceptible to damage by virtue of their arrangement. Thus, for example, when touching the bottom there is the danger of the vanes breaking off. The same is also true if foreign bodies are present in the water. And also, when aquatic plants are about, there is a risk of clogging.

OBJECT AND SUMMARY OF THE INVENTION

Consequently the underlying object of the present invention is to create a device for generating a thrust which is less susceptible to external factors.

This object is achieved in accordance with the invention in that the thrust generating members are embodied as rotary cylinders which individually undergo a reversal in their direction of rotation after every half revolution of the hub, the points of reversal and thus the direction of thrust being adjustable through eccentric location of a control bar connected to the rotary cylinders relative to the axis of rotation of the hub.

In achieving the object in accordance with the invention use is made of the known Magnus effect.

When a rotating body is simultaneously subjected to an oncoming flow, a force or a thrust is produced at right angles to the oncoming flow. As the flow passes around the rotating body, higher speeds prevail on the side on which the direction of rotation is the same as that of the parallel flow, which indicates a lower pressure. On the other side, however, a higher pressure is produced. Thus, a force is generated at right angles to the oncoming flow in the direction of the lower pressure.

Now in accordance with the invention this effect is utilized, through the indicated features, to produce a propulsive thrust. In each case the rotary cylinders disposed on the rotating hub are attacked by the oncoming flow tangentially. According to the direction of rotation and the location of the points at which the direction of rotation of the rotary cylinders is reversed, the individual forces acting on the rotary cylinders can be harnessed together to provide an overall thrust. Here this is achieved through each rotary cylinder changing its direction of rotation once during one revolution; i.e., the rotational speed becomes zero twice and reaches a maximum twice. The magnitude of the thrust is determined here by the speed of rotation while the direction of the thrust is fixed by the phase relationship of the beginning or end of a direction of rotation.

In comparison with vanes the rotary cylinders are less fragile and their shape reduces the risk of clogging by plants and the like. In addition, less noise is developed.

One embodiment in accordance with the invention consists in having the rotary cylinders drivable in each case through a shaft turning with the hub by means of a friction wheel fixed on the shaft and running on a stationary plate, the orbit diameter and the position of the circular orbit made by the friction wheel on the plate being determined by means of a linkage connected to a control bar.

The location and adjustment of the control bar which operates the linkage can be effected, for example, by means of a device such as described in German published specification 2 029 995 = U.S. Pat. Ser. No. 3,704,961 for adjusting the vane linkage in a Voith Schneider propeller.

Since the path between the friction wheel and the pivot point of the hub points towards the rotary cylinder once and leads away from it once during the revolution, the direction of rotation of the associated rotary cylinder also changes correspondingly during a revolution.

A further embodiment in accordance with the invention consists in having the rotary cylinders drivable in each case by means of a hydraulic motor which is connected to a servo control unit by pressure lines, the piston rod of the servo control unit being connected to the control bar by means of a crank assembly.

Since the control bar is stationary while the servo unit with the piston rod and the crank assembly with the hub rotate, the piston rod is moved in or out accordingly. Through this the pressure lines for the hydraulic motor are correspondingly filled with oil as a result of which the changes in the direction of rotation of the rotary cylinder are produced during the hub revolution.

Another embodiment in accordance with the invention consists in having a toothed rack articulating with the control bar, this rack working with a pinion connected to the rotary cylinder either directly or through a step-up gear system.

Naturally the reversal in the direction of rotation of the rotary cylinders can also be achieved electrically by means of electric motors with suitable control means.

In the following, three exemplary embodiments of the invention are described showing further features in accordance with the invention.

BRIEF DESCRIPTION OF THE DRAWINGS

FIG. 3 illustrates the operating principle of one exemplary embodiment of the invention;

FIG. 4 illustrates a plan view of the exemplary embodiment of FIG. 3;

DESCRIPTION OF THE PREFERRED EMBODIMENT

Figure 1:
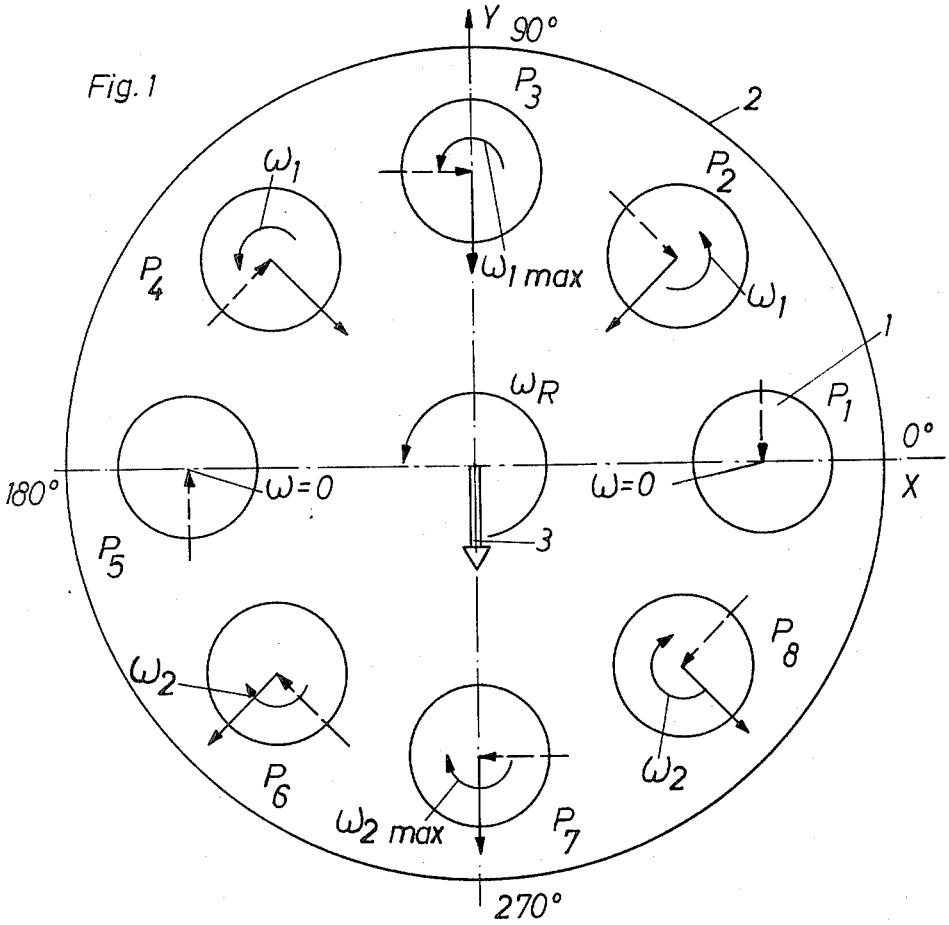
FIG. 1 illustrates the operating principle of the device in accordance with the invention.

In FIG. 1 the method of operation of rotary cylinders 1 is shown during one hub revolution. The rotary cylinders 1 are disposed on a hub 2 rotating at an angular speed $\omega_R$. A coordinate system of axes is superimposed on the figure for better understanding. When the rotary cylinder 1 is on the positive X-axis (0°), its rotary speed is 0 (position P1). Through the rotation of the hub 2, the rotary cylinders are attacked tangentially by an oncoming flow (broken arrows). From position P1 onwards, the rotary cylinders increasingly acquire an angular speed $\omega_1$ which attains its maximum at 90° (position P3). Through this angular speed coupled with the tangential attack, according to the Magnus effect a thrust component is produced, indicated by the solid radially directed arrows. In position P5 at 180° the rotary speed of the rotary cylinders has reverted to zero, after which it is again increased up to the maximum (position P7) in the opposite direction of rotation and then reduced to zero again (position P1). The resultant of all the thrust components is shown by the arrow 3. Its magnitude is determined by the angular speeds. By shifting the axes system, i.e., by fixing the zero positions of the rotary cylinders, the direction of the thrust can be adjusted. A plurality, preferably 4–6, of rotary cylinders can be disposed on the hub as desired, all of which successively adopt the described positions and thus combine in their effect.

Figure 2:
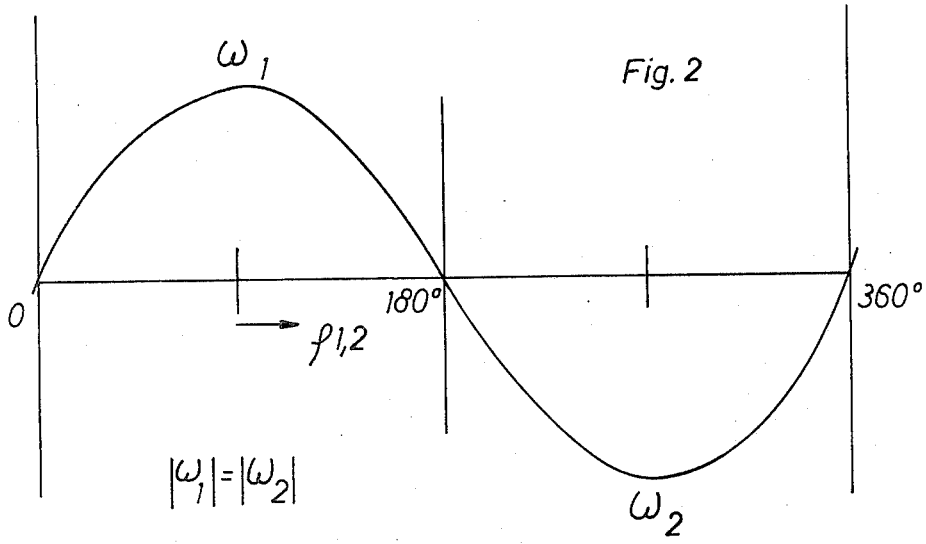
FIG. 2 illustrates the sinusoidal pattern for the angular speed of a rotary cylinder.
Figure 5:
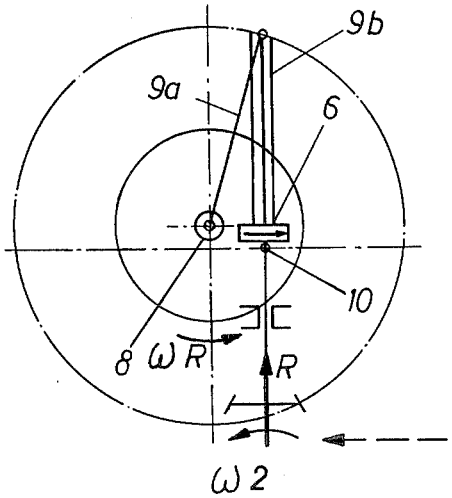
FIGS. 5 to 7 illustrate various positions of the friction wheel.
Figure 6:
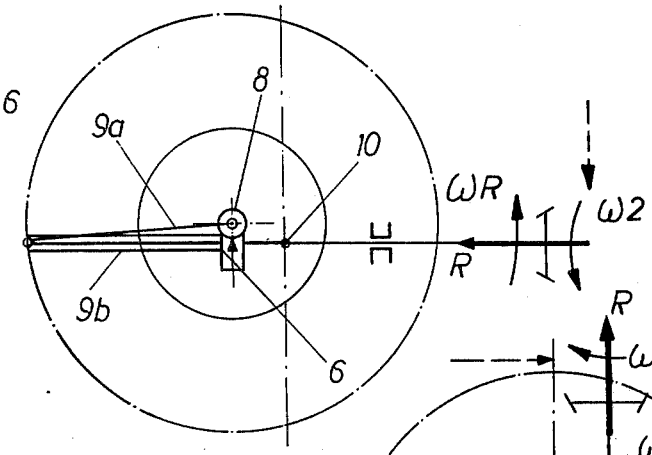
Figure 7:
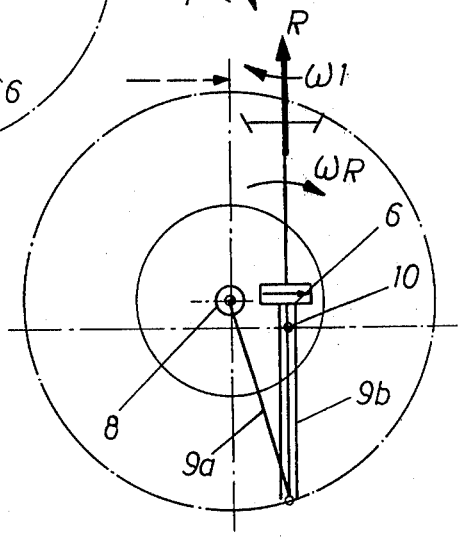

In FIG. 2 the angular speed of a rotary cylinder is indicated during one revolution of the hub. As is evident from this, it exhibits a sinusoidal pattern in which $$|\omega_1| = |\omega_2|$$

In FIGS. 3 to 7 an exemplary embodiment is shown having a mechanical drive arrangement.

The rotary cylinders 1 (only one is shown) are driven by means of gears 4 and shafts 5. The shafts 5 and the gears 4 are disposed in the hub 2 and revolve with it. Each shaft 5 carries a fixed but axially displaceable friction wheel 6 which rolls on a plate 7. The plate 7 is stationary and is prevented from rotating by an equally stationary control bar 8. The control bar 8 is fixed at the pivot pin 25 in the propeller housing, which is installed at the bottom of the ship. The friction wheel 6 is connected to the control bar 8 by means of a crank assembly 9*a* and 9*b*. Any number of rotary cylinders 1 may be chosen. Preferably four to six are disposed on the hub 2, each having associated with it a pair of gears 4, a shaft 5, a friction wheel 6 and a crank assembly 9*a* and 9*b*.

The path described by the friction wheels 6 is fixed by an eccentric adjustment of the control bar 8. The eccentricity of the control bar 8 can be set as desired by means of two servo motors 23,24 disposed at right angles to one another (shown in FIG. 8). Here the crank assembly 9*a* and 9*b* moves the friction wheel 6 along a circular orbit in unison with the speed of the hub 2. Since the distance separating the friction wheel 6 and the pivot point 10 of the hub 2 points towards the rotary cylinder 1 once and points away from the rotary cylinder once, and runs through the pivot point 10 twice during one revolution in each case, the rotary cylinder comes to a halt twice and its direction also changes accordingly during a revolution.

FIGS. 4 to 7 show various positions of the friction wheel 6 and the crank assembly 9*a* and 9*b*. When viewed constantly in the direction from the rotary cylinder 1 towards the pivot point 10 of the hub 2, the friction wheel 6 turns counter-clockwise in FIG. 4, clockwise in FIG. 5, clockwise in FIG. 6 as well and counter-clockwise again in FIG. 7. The directions of rotation $\omega_1$ and $\omega_2$ of the rotary cylinder 1 are reversed by the gearing 4 relative to the shaft 5. The control bar 8 maintains its position in each case and the crank element 9*a* moves along a circular orbit around the lower end of the control bar 8, acting as a center point. During one hub revolution therefore the friction wheel 6 passes through the pivot point 10 twice with a subsequent reversal in direction of rotation, i.e., between the positions shown in FIGS. 4 and 5 and then between the positions shown in FIGS. 6 and 7. In each case the direction from which the rotary cylinders 1 are attacked is indicated by broken arrows and the resultant force by arrows R.

Figures 8, 9:
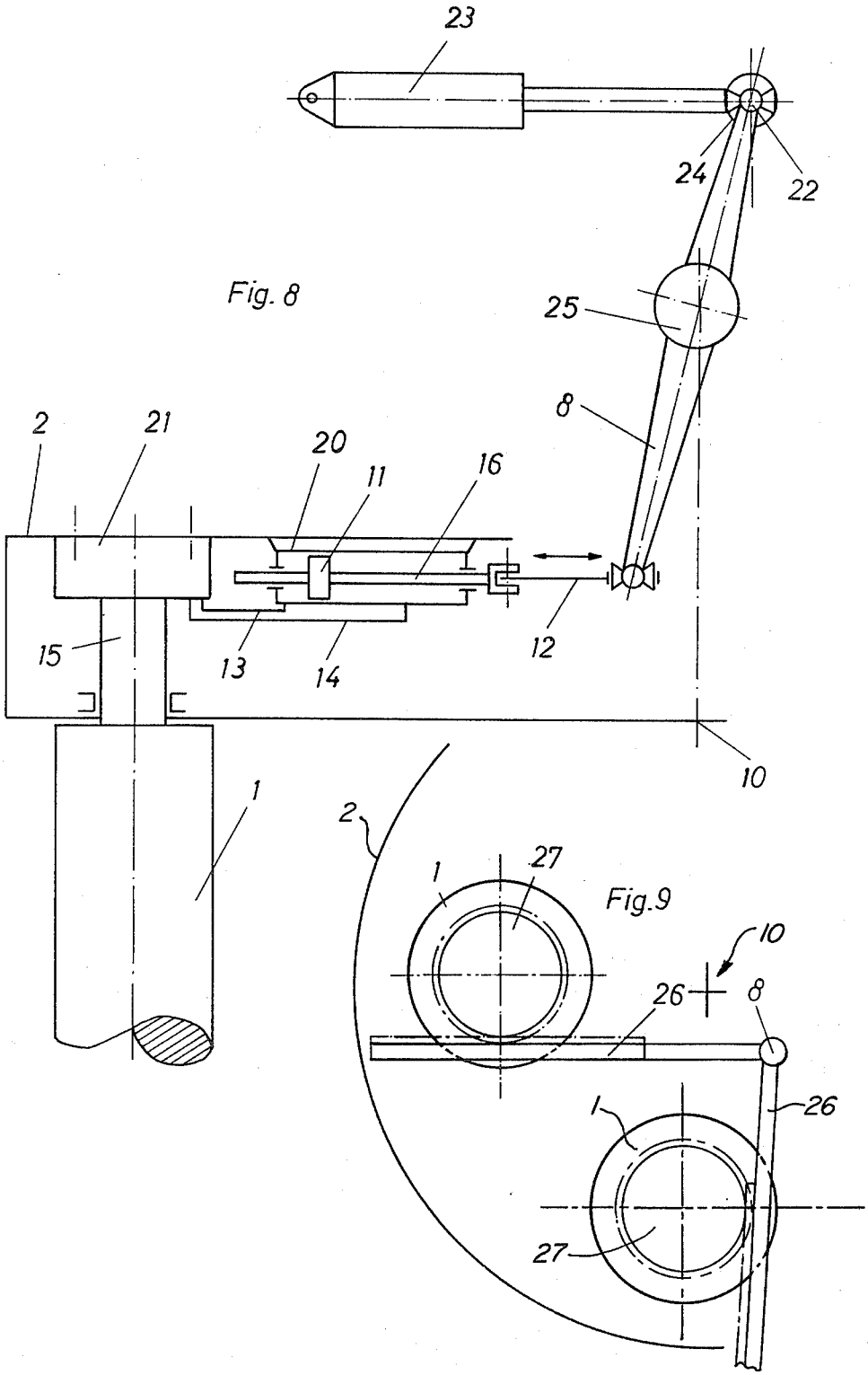
FIG. 8 illustrates the operating principle of another exemplary embodiment in accordance with the invention.
FIG. 9 illustrates the operating principle of a further exemplary embodiment in accordance with the invention in a plan view.

In FIG. 8 an exemplary embodiment is shown having a mechanical-hydraulic drive. With this drive a servo control unit 20 with a hydraulic piston 11 is moved by a crank assembly 12 connected to the control bar 8. Compressed oil flows along pressure lines 13 and 14 to a hydraulic motor 21 which is fixed on the shaft 15 of the rotary cylinder 1. The step-up ratio and the direction of rotation between hub 2 and rotary cylinder 1 is determined for a given delivery from the hydraulic piston 11 by the "absorption" capacity of the hydraulic motor 21, which may be a cell motor, an axial piston motor or a radial piston motor.

Here as well the stroke of the hydraulic piston 11 and thus the speed of the rotary cylinder 1 are set to the desired magnitude through the eccentricity of the crank assembly 12 or control bar 8. Depending upon the position of the control bar 8, which in contrast to the crank assembly 12 and the hydraulic piston 11 does not rotate with the hub 2, the piston rod 16 of the hydraulic piston 11 is accordingly displaced axially, through which the pressure chambers are either drained or filled with hydraulic fluid. The eccentricity of the control bar 8 is set by two servo motors 23 and 24 situated at right angles to one another and acting on a common bearing point 22. In the process the control bar 8 is moved about the pivot pin 25.

In both exemplary embodiments the accelerating and braking moments of the rotary cylinders 1 act through the transmission elements upon the control bar 8 and there produce corresponding braking and acceleration moments at the hub 2. If one disregards the losses in the transmission elements, no additional input is necessary to change the speed of the rotary cylinders 1.

The drive illustrated gives a sinusoidal pattern for the rotational speed. If other curves are necessary for improved efficiency levels, these can be achieved by different kinematics. It is also possible to select $\omega_1 \neq \omega_2$ In addition to the two illustrated control devices for the speed and the direction of rotation of the rotary cylinders 1, other embodiments are also possible. They merely have to achieve the object of accelerating each rotary cylinder 1 from zero to maximum in both directions of rotation during one hub revolution. This can also be achieved with a rack and pinion, for example, as indicated in FIG. 9. Here each of the racks 26 is articulated with the control bar 8 at one end and works with a pinion 27 which is connected to the rotary cylinder 1 either directly or indirectly through step-up gearing. In this case each of the racks 26 is moved to-and-fro by the control bar 8 and thus imparts a corresponding rotary motion to the rotary cylinder 1 through the pinion 27. As in the embodiment of FIG. 8, the eccentricity of the control bar 8 is set by the two servo motors 23 and 24.

Figure 10:
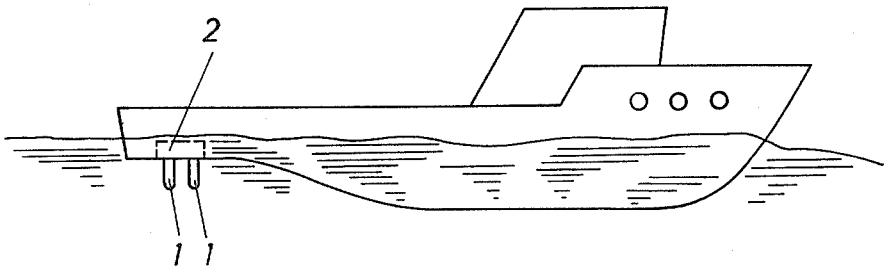
FIG. 10 illustrates a ship with the device in accordance with the invention.

FIG. 10 illustrates the device in accordance with the invention fitted in a ship.

Figure 11:
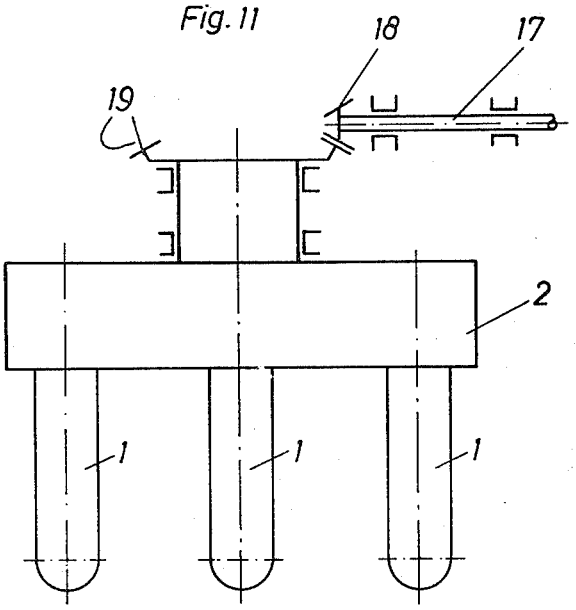
FIG. 11 gives a complete view of the device in accordance with the invention with a drive showing the operating principle.

In FIG. 11 the hub 2 is driven through a main shaft 17 with a gear 18 on a ring gear 19 and this arrangement is used to drive the hub 2 in the embodiment of FIG. 9.

Instead of propelling a ship, the device in accordance with the invention can be used for pumping. The drive is particularly suitable for conveying sensitive merchandise, e.g., for fish when there is the risk of decapitation. With this even aggressive media which attack a pump, such as gritty suspensions, can be conveyed without any risk of damage to the pump.

What is claimed is:

1. A device for generating a thrust in a liquid, comprising:

a rotary hub defining an axis of rotation;

a plurality of thrust generating cylinders rotatably mounted on said rotary hub in uniformly spaced circumferentially extending relationship, means for driving said rotary hub and said thrust generating cylinders, said cylinders each defining an axis of rotation parallel to and uniformly spaced from the axis of rotation of the hub;

a common control bar; and linkage means connecting each cylinder to said common control bar, a pinion connected to the cylinder; a rack pivotably mounted to said common control bar and engageable with the pinion, wherein each cylinder changes its direction of rotation, and thus the direction of the generated thrust, each half revolution of the hub, and wherein said common control bar is connected to each linkage means for occupying an eccentric relationship with the hub axis of rotation during the driving of said cylinders with said eccentric relationship dependent on the driving force and direction and for occupying a coincident position with respect to said hub axis of rotation during an idling operation of said driving means.

2. The device as defined in claim 1, wherein the linkage means includes: a step-up gear system connected to the pinion; said rack pivotably mounted to the common control bar and engageable with the step-up gear system.

* * * * *